US008988194B2

(12) United States Patent
Lim

(10) Patent No.: US 8,988,194 B2
(45) Date of Patent: Mar. 24, 2015

(54) METHOD AND SYSTEM FOR CONTROLLING ELECTRONIC DEVICE USING EXTERNAL DEVICE

(75) Inventor: Dok Shin Lim, London (GB)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 758 days.

(21) Appl. No.: 12/883,246

(22) Filed: Sep. 16, 2010

(65) Prior Publication Data

US 2011/0068902 A1 Mar. 24, 2011

(30) Foreign Application Priority Data

Sep. 22, 2009 (KR) ..... 10-2009-0089494

(51) Int. Cl.
*G08C 17/00* (2006.01)
*G08C 17/02* (2006.01)

(52) U.S. Cl.
CPC ..... *G08C 17/02* (2013.01); *G08C 2201/93* (2013.01)
USPC ..... 340/10.1

(58) Field of Classification Search
CPC ..... G08C 17/00; G08C 17/02; G06K 7/0008
USPC ..... 340/10.1, 10.4, 10.41, 10.5, 10.51, 340/572.1; 726/2
See application file for complete search history.

(56) References Cited

U.S. PATENT DOCUMENTS

| | | | | |
|---|---|---|---|---|
| 6,008,727 | A * | 12/1999 | Want et al. | 340/572.1 |
| 6,677,852 | B1 * | 1/2004 | Landt | 340/10.1 |
| 6,853,294 | B1 * | 2/2005 | Ramamurthy et al. | 340/10.1 |
| 8,045,697 | B1 * | 10/2011 | Martin | 379/265.12 |
| 2006/0168644 | A1 * | 7/2006 | Richter et al. | 726/2 |
| 2007/0067325 | A1 * | 3/2007 | Weitzner et al. | 707/101 |
| 2008/0078676 | A1 * | 4/2008 | Chiu et al. | 204/403.01 |
| 2008/0254780 | A1 * | 10/2008 | Kuhl et al. | 455/418 |
| 2009/0150889 | A1 * | 6/2009 | Yamaguchi et al. | 718/102 |

* cited by examiner

*Primary Examiner* — Edwin Holloway, III
(74) *Attorney, Agent, or Firm* — Cha & Reiter, LLC.

(57) ABSTRACT

A method and system for controlling an electronic device with information provided by an external device through a wired or wireless interface is provided. An electronic device control method of the present invention includes detecting an event; acquiring execution information associated with the event; and executing a task indicated by the execution information.

20 Claims, 8 Drawing Sheets

METHOD AND SYSTEM FOR CONTROLLING ELECTRONIC DEVICE USING EXTERNAL DEVICE

CLAIM OF PRIORITY

This application claims, pursuant to 35 USC 119, priority to, and the benefit of the earlier filing date of, that patent application filed in the Korean Patent Office, entitled "Method and System for Controlling Electronic Device using External Device, on Sep. 22, 2009 and afforded serial number 10-2009-0089494, the entire contents of which is incorporated by reference herein.

BACKGROUND OF THE INVENTION

1. Field of the Invention

The present invention relates to an electronic device and, in particular, to a method and system for controlling an electronic device with information provided by an external device through a wired or wireless interface.

2. Description of the Related Art

With the rapid advance of electronic technologies and diversification of functions integrated into electronic devices, various types of user interfaces have been developed along with interface-specific functions. Particularly, mobile devices are widely used, without distinction of age or sex, for various purposes with the advantages of mobility and usability.

However, when encountering a new kind of electronic device or a function that is not commonly used, even the person who is familiar with the electronic device, such as mobile phone, is likely to feel difficult to understand the operation of the new device or function. This means that, if the user does not have full knowledge about the operation of the electronic device, it can be difficult to use the electronic device or specific function(s). Accordingly, in order to use a new electronic device or new function of an electronic device, the user has to search the manual for the function or applications to execute, and this is a time-consuming and sometime frustrating experience. Particularly when the user intends to execute a specific application to generate specific data with a user interface corresponding to the executed application, all these manipulation steps for generating the data can be troublesome for the user. Such a problem can be felt more significantly by older users or persons.

SUMMARY OF THE INVENTION

In order to overcome the problems of the prior art, the present invention provides a method and system for controlling electronic device using an external device. Also, the present invention provides a method and system for controlling an electronic device based on the execution information of an external device.

Further, the present invention provides a method and system for controlling an electronic device that is capable of executing a function guide corresponding to the execution information acquired from an external device through a wired or wireless interface.

Further, the present invention provides a method and system for controlling an electronic device that is capable of acquiring execution information from an external device through a wired or wireless interface and executing an application of the electronic device and generating application data automatically by referencing the execution data.

Moreover, the present invention provides a method and system for controlling an electronic device that is capable of facilitating application data input and generation with reference to tag information provided by an external device.

Furthermore, the present invention provides a method and system for controlling an electronic device that is capable of acquiring execution information radiated by an external device through a communication interface and executing an operation based on the execution information.

In accordance with an aspect of the present invention, a method for controlling an electronic device includes detecting an event from an external device, the external device including information regarding operation of at least one task of the electronic device; acquiring execution information associated with the event from the external device; determining a task associated with the execution information; and executing a task indicated by the execution information.

Preferably, detecting an event includes sensing a connection of an external device to the electronic device through a predetermined communication interface; and reading out tag information from the external device through the communication interface.

Preferably, acquiring execution information includes converting the tag information into the execution information; and parsing the execution information to extract application identity information.

Preferably, acquiring execution information further includes extracting data information from the execution information.

Preferably, executing a task includes loading an application identified by the application identity information; and controlling execution of the task by means of the loaded application.

Preferably, controlling execution of the task includes activating a guide mode for guiding a specific function of the electronic device.

Preferably, controlling execution of the task includes executing the application identified by the application identity information and displaying an execution screen of the application.

Preferably, controlling execution of the task further includes generating application data based on the data information by means of the application.

Preferably, generating application data includes filling data input fields of the application with data elements of the data information automatically.

In accordance with another aspect of the present invention, an electronic device control system includes an external device having tag information, the tag information including information regarding at least one task of the electronic device; and an electronic device that reads out the tag information from the external device through a predetermined communication interface, extracts execution information from the tag information, determines a task indicated with the execution information, and executes the task indicated by the execution information.

Preferably, the communication interface includes at least one of a wired communication interface and a wireless communication interface.

Preferably, each of the electronic device and the external device includes a communication interface unit for establishing the communication interface.

Preferably, the communication interface is a Radio Frequency Identification (RFID) interface, the external device includes an RFID tag, and the electronic device includes an RFID reader.

Preferably, the electronic device includes a control unit that converts the tag information into the execution information, loads an application indicated by the execution information, and controls execution of the task with the application.

Preferably, the control unit includes a converter that converts the tag information into the execution information that can be read by the electronic device; an extractor that performs parsing on the execution information to extract application identity information and data information; and an executor that loads the application indicated by the application identity information to execute the task.

Preferably, the control unit executes a guide application for study of a specific function of the electronic device or executes a specific application and fills data input fields of the application with data elements of the data information automatically.

In accordance with still another aspect of the present invention, an electronic device includes a communication interface unit that reads out tag information from an external device through a wired or wireless communication interface; a control unit that converts the tag information to execution information, loads an application indicated by the execution information, and controls execution of a task with the application; and an output unit that outputs at least one of video data and audio data as a result of the task execution.

In still another aspect of the invention, an electronic device is disclosed comprising a short-range communication protocol interface; a processor in communication with a memory, the memory including code, which when accessed by the processor causes the processor to: read tag information from an external device through the short range communication protocol interface, the tag information including information regarding at least one task of the electronic device; convert the tag information to execution information, load an application indicated by the execution information, and execute a task associated with the application.

BRIEF DESCRIPTION OF THE DRAWINGS

The above and other objects, features and advantages of the present invention will be more apparent from the following detailed description in conjunction with the accompanying drawings, in which.

DETAILED DESCRIPTION OF THE INVENTION

Figure 1:
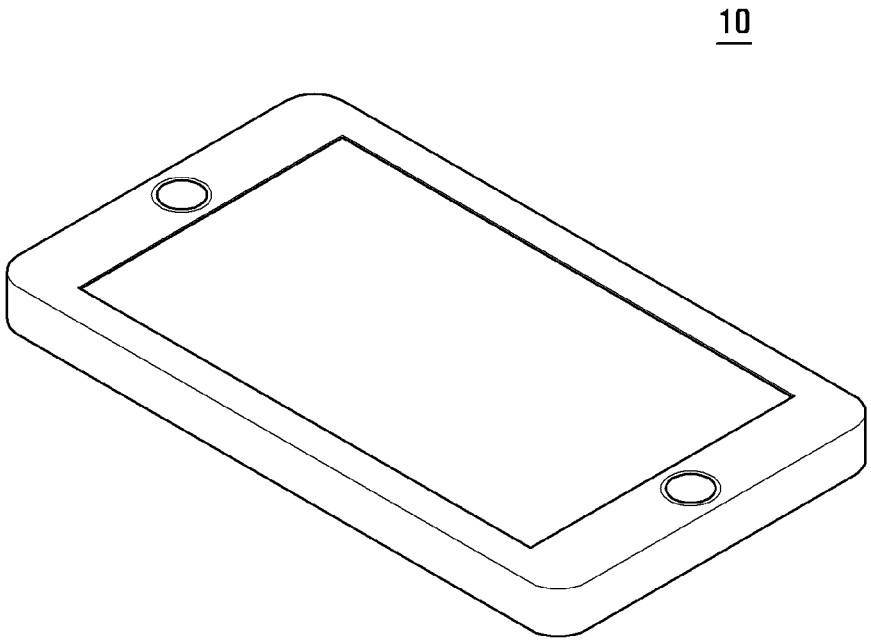
FIGS. 1 to 3 are schematic diagrams illustrating various types of electronic devices to which the present invention is applied according to exemplary embodiments of the present invention.

Exemplary embodiments of the present invention are described with reference to the accompanying drawings in detail. The same reference numbers are used throughout the drawings to refer to the same or like parts. Detailed description of well-known functions and structures incorporated herein may be omitted to avoid obscuring the subject matter of the present invention.

The present invention relates to a method and system for controlling an electronic device. In an exemplary embodiment of the present invention, a method and system for executing a function of an electronic device using an external device in a simple and intuitive manner is disclosed. The electronic device according to an exemplary embodiment of the present invention can support at least one of a wired and a wireless interface. According to an exemplary embodiment of the present invention, the electronic device and the external device can be connected with each other through a wired communication interface or a wireless communication interface. According to an exemplary embodiment of the present invention, the external device is connected to the electronic device through a communication interface and controls the electronic device remotely.

In an exemplary embodiment of the present invention, the electronic device and the external device are connected with each other through a wireless interface established by means of a wireless network technology such as Personal Area Network (PAN) or a wired interface established by means of a Universal Serial Bus (USB), data connector, FireWire, or i.Link. Firewire and i.Link are brand names of the Apple Company, Cupertino, Calif., and Sony Corporation, Tokyo, Japan, respectively, of an IEEE 1394 communication interface protocol.

In an exemplary embodiment of the present invention, the PAN means a network established for communication among various electronic devices within a coverage area of the device. In exemplary embodiment of the present invention, the wireless network technology can be any of an Infrared Data Association (IrDA), Bluetooth, Ultra Wideband (UWB), ZigBee, WiFi, and Radio Frequency Identification (RFID), which are well-known short-range communication protocols and a detailed description of their operating characteristics are known to those skilled in the art and need not be presented in detail herein to understand the principles of the invention claimed.

Although the description is directed to the system using the RFID as the short range wireless communication technology, the present invention is not limited to the RFID-based system but can be applied to the systems using various types of short range wireless communication technologies.

Here, the RFID technology is a technology that reads out information remotely using radio wave. In RFID technology, an RFID reader reads out information from RFID tags. That is, the RFID technology is an auto-recognition technology for recognizing information stored in a microchip wirelessly using a microwave or a long wave. The RFID tag is composed of an antenna and an Integrated Circuit (IC). The IC stores information and the antenna radiates the information such that the RFID reader reads the information. The information is used for identifying the object on which the RFID tag is attached.

In an exemplary embodiment of the present invention, the electronic device and the external device can connect to each other through a communication interface. The electronic device receives the execution information transmitted by an external device by means of a communication interface unit and executes the function instructed by the execution information. For example, the electronic device reads out the tag information recorded in the external device by means of the communication interface unit and executes a task according to the execution information extracted from the tag information.

In an exemplary embodiment of the present invention, the electronic device control system can be composed of an electronic device, an external device for controlling the electronic device, a communication interface between the electronic device and the external device, and an application running in the electronic device according to a control command transmitted by the external device. Here, the communication interface is the aforementioned RFID communication interface and can be an RFID reader to read out the RFID tag of the external device.

In an exemplary embodiment of the present invention, it is possible to control the operation of the electronic device dynamically using the external device having user-intended interaction information (e.g. tag information). In an exemplary embodiment of the present invention, the external device can include an RFID tag and control the electronic device having the RFID reader to perform a specific task on behalf of the user. For example, the external device operates as a remote control with the electronic device to facilitate executing a specific application and/or generating specific data in order for the user to learn the menu (operation) of the electronic device.

A description is made of the method and system for controlling an electronic device using an external device hereinafter. However, the present invention is not limited to the following description but can be practiced with various equivalents and modifications in other embodiments.

Figure 2:
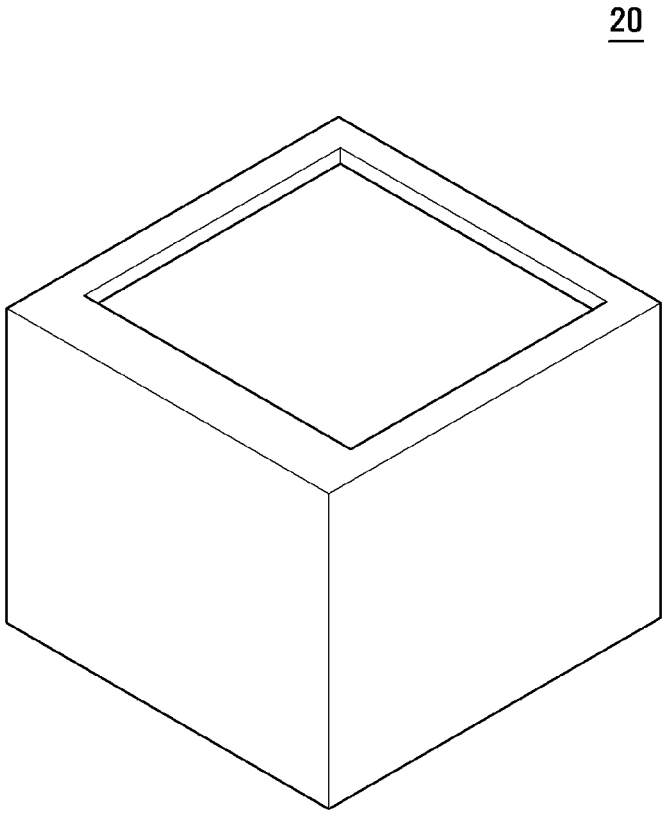
Figure 3:
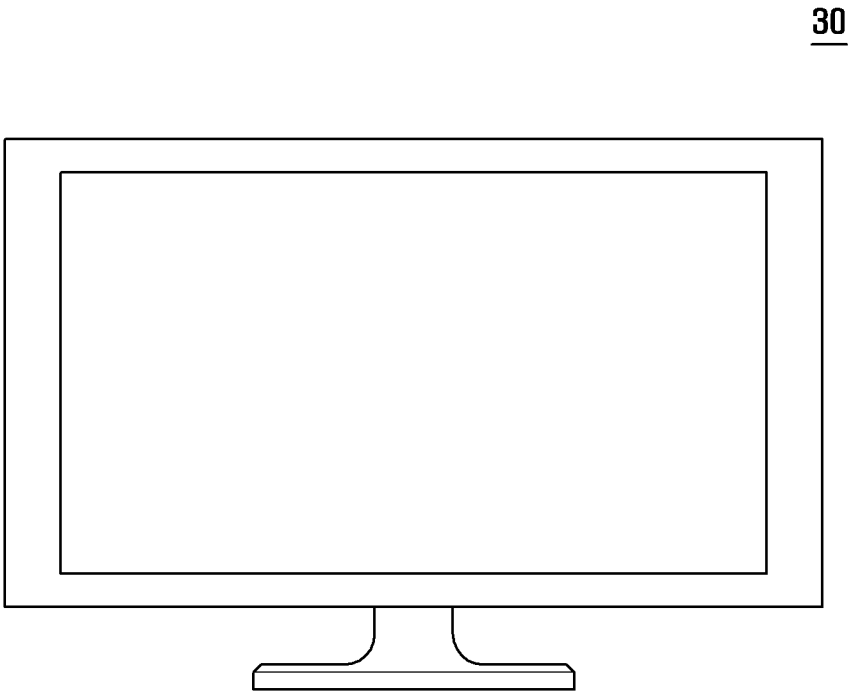

FIGS. 1 to 3 are schematic diagrams illustrating various types of electronic devices to which the present invention is applied according to exemplary embodiments of the present invention.

The mobile terminal 10 of FIG. 1 can be any one of a plurality of mobile communication terminals operating with communication protocols implemented in various communication systems, Personal Multimedia Player (PMP), Digital Broadcast Player, Personal Digital Assistant (PDA), music player (e.g., MP3 player), Smartphone, and their equivalents The electronic information system 20 of FIG. 2 can be any one of a plurality of screen monitors and media poles that may be fixed on walls, posts, and on the ground in museums, pavilions, amusement parks, and roads for providing guidance information in response to a user's request.

Also, the monitor 30 of FIG. 3 can be any one of a plurality of television, monitor-integrated personal computer, laptop computer, etc.

Each of the exemplary electronic devices depicted in FIGS. 1 to 3 includes a communication interface unit for supporting at least one of wired and wireless communication interfaces. The description is directed to the electronic device having a communication interface implemented on the basis of RFID technology. Accordingly, the electronic device includes an RF ID reader and a communication interface unit supporting the functions corresponding to the RFID reader. The communication interface unit can be implemented in various forms depending on the design of the electronic device. For example, the electronic device can include at least one of wireless communication module (such as IrDA module, Bluetooth module, UWB module, ZigBee module, and WiFi module) and wired communication module (such as data connector, USB module, Firewire module, i.Link connector).

As shown in FIGS. 1 to 3, the electronic device of the present invention can be a device fabricated in any shape and any size that can execute operations indicated by the execution information received through the communication interface configured to establish a connection with an external device. Although the description is made with a mobile terminal as an example, the present invention can be applied to various types of electronic devices.

The electronic device according to an exemplary embodiment of the present invention establishes a connection with an external device via the communication interface and acquires the execution information from the external device. The electronic device executes a guide mode in which the user can learn how to manipulate specific functions according to the execution information or performs a specific function and/or play specific data according to the execution information.

Figure 4:
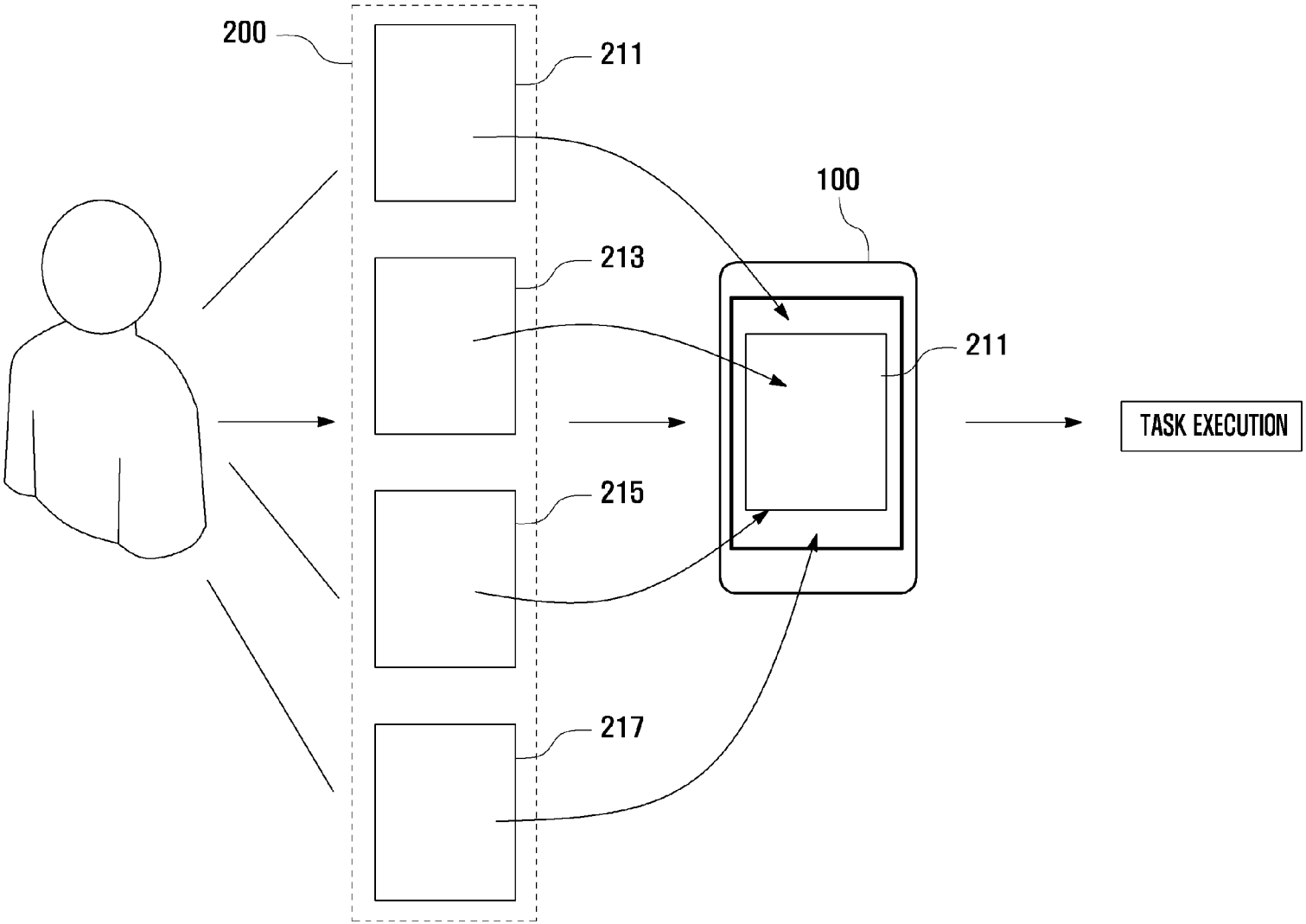
FIG. 4 is a schematic diagram illustrating an operation principle of a system for controlling an electronic device according to an exemplary embodiment of the present invention.

FIG. 4 is a schematic diagram illustrating an operating principle of a system for controlling an electronic device according to an exemplary embodiment of the present invention.

As shown in FIG. 4, the electronic device control system according to an exemplary embodiment of the present invention includes an electronic device 100 having an RFID reader and at least one external device 200 having an RFID tag. In FIG. 4, it is assumed that the electronic device is a mobile terminal. The external device 200 can be a device of the aforementioned types of devices and their equivalents in the shape of a credit/business card. In FIG. 4, the external device is depicted in the shape of a credit/business card.

The external device 200 stores at least one tag information for use in controlling the electronic device 100, and the tag information can be provided by the RFID tag. In case that the external device 200 is provided with a barcode, the tag information can be provided by a barcode. In case that the external device is a mobile terminal such as mobile phone, PDA, and laptop computer, the external device can be configured to provide a control code in response to a user input. In this case, the electronic device 100 receives the tag information from the external device 200 by means of one of a RFID tag, a barcode, and a control code and executes an operation corresponding to the execution information extracted from the tag information.

Referring to FIG. 4, the user can control the electronic device 100 by means of the external device 200. The electronic device 100 can include at least one application for executing the function indicated by the execution information extracted from the tag information of the external device 200. For example, the application can be the application running on the electronic device 100 in association with the execution information acquired from the external device 200 and executes a user-intended task in a stepwise manner according to the execution information.

The user selects at least one of the external devices 211 to 217 storing the tag information that the user wants and connects the selected external device to the electronic device 100 through the communication interface. Once the connection between the electronic device 100 and the selected external device is established, the electronic device 100 executes the task corresponding to the execution information extracted from the execution information. The task can be a procedure composed of a series of steps of executing an application corresponding to the execution information and generating specific data as a consequence of the application execution or a series of provisions of guide information for helping the user learn about specific function of the electronic device 100.

The application included in the electronic device 100 can identify the execution information acquired from the external devices 211 to 217 and can execute the function corresponding to the execution information. The user can execute a specific application by means of an external device so as to play specific contents data with the execution of the application and learn about functions and menus of the electronic device in intuitive manner.

As described above, the electronic device 100 can provide automatic application execution, automatic data generation, and automatic menu study functions as well as data acquisition and feedback functions, and the user can control the electronic device 100 using the external devices 211 to 217.

Referring to FIG. 4, the user can select one of the external devices (211-217) that has tag information which the user wants to access. For example, the external devices may include a device 211 having tag information related to the menu navigation guide (or instruction), a device 213 having tag information related to a message composition guide, a device 215 having a tag information related to a phonebook application execution and phonebook data input guide, and a device 217 having a tag information related to the message application execution and data messaging guide. A description is made of the exemplary case where the user selects the external device 211.

If a decision is made to understand or learn (study) how to navigate menus of the electronic device, the user selects the external device 211 having tag information on the menu navigation guide among the external devices 211 to 217. In case that the task is a menu navigation guide, the user selects the external device 211 having tag information related to the menu navigation guide. The tag information can be provided by an RFID tag.

The user can connect the external device 211 to the electronic device 100. The connection between the external device 211 and the electronic device 100 can be done simply by placing the external device 211 close to the electronic device 100 such that an RFID reader of the electronic device 100 is within radio range of the RFID tag of the external device 211. That is, the user can take an action that initiates communication between the RFID tag of the external device 211 and the RFID reader of the electronic device 100. If the electronic device 100 is in the radio range of the RFID tag of the external device 211, the electronic device 100 and the external device 211 are connected to each other through a preset communication interface (e.g. interface between RFID reader and RFID tag).

Once the external device 211 is connected, the electronic device 100 reads out the tag information from the RFID tag of the external device 211 to acquire the execution information and extracts application identity information and/or data information from the execution information.

Next, the electronic device 100 loads the application identified by the application identity information to execute the task requested by the user such that the application performs operations related to the task.

Table 1 shows exemplary functions provided by individual applications of the electronic device 100.

TABLE 1

| Exemplary functions | | | | |
|---|---|---|---|---|
| | Execution information | | | |
| | | Data info. | | |
| App. | App. ID Info. | Field Info. | Content Info | Function |
| App. 1 | 0001 | 00 | X | Menu navigation guide |
| App. 2 | 0002 | 00 | X | Message composition guide |
| App. 3 | 0003 | 01 | Name | Execute phonebook application and generate phonebook data |
| App. 4 | 0004 | 01 | Content | Execute messaging app. and compose message |

TABLE 1-continued

| Exemplary functions | | | | |
|---|---|---|---|---|
| | Execution information | | | |
| | | Data info. | | |
| App. | App. ID Info. | Field Info. | Content Info | Function |
| | | 02 | Phone No. | |
| | | 03 | Email | |
| | | 02 | Phone No. | |
| | | . | | |
| | | . | | |
| | | . | | |

Referring to Table 1, the electronic device 100 reads out the tag information from the RFID tag of the external device 211 by means of the RFID reader and converts the tag information into the form of the execution information. The electronic 100 performs parsing of the execution information to extract application identity information. The electronic device 100 can identify the application requested to be executed based on the application identity information. For example, the application identity information of "0001" indicates application 1, the application identity information of "0002" indicates application 2, the application identity information of "0003" indicates application 3, and the application identity information of "0004" indicates application 4.

Here, application 1 provides a menu navigation guide, application 2 provides a message composition guide, application 3 provides a phonebook application for supporting creation of phonebook data, and application 4 is a messaging application for supporting messaging function. Particularly, application 3 and application 4 can create the application data (phonebook data or message content) automatically when they are executed.

As shown in Table 1, the execution information is composed of application identity information and data information. For example, an application for providing guidance about specific functions such as application 1 and application 2 or an application for executing a specific function such as a camera application needs no data information; and, thus, the data application can be omitted. In case of the application that is capable of generating specific data such as application 3 and application 4, if there is no data information in the execution information, the electronic device 100 can execute the corresponding application with a blank execution screen of the application.

Next, the electronic device loads the application indicated by the application identity information and executes the task corresponding to a user request by means of the application. At this time, the electronic device 100 outputs video and/or audio data through corresponding output units as a result of the task execution. For example, video data may be output through a display, and corresponding audio data may be output through a speaker.

Referring to FIG. 4, when the external device 211 is connected, the electronic device 100 acquires the tag information of the external device 211 by means of the RFID reader and converts the tag information into the form of execution information that the electronic device 100 can recognize. The electronic device 100 performs parsing of the execution information to acquire the application identity information of the application 1, as shown in Table 1. The electronic device 100 loads and executes the application 1 for providing the menu navigation guide. Next, the electronic device 100 executes the application 1 to provide the user-intended task (e.g., application 1—menu navigation guide) in a stepwise manner. That is, the electronic device 100 outputs the video and audio data in series according to the progress of the menu navigation guide program.

A description is now made of the exemplary case where the user selects the external device 213.

If a decision is made to study or learn how to compose a message using the electronic device, the user selects the external device 213 having tag information regarding the message composition guide. The tag information can be provided by an RFID tag. The user can connect the external device 213 to the electronic device 100. The connection between the external device 213 and the electronic device 100 can be done simply by placing the external device 213 close to the electronic device 100 such that the RFID reader of the electronic device 100 is within radio range of the RFID tag of the external device 213. That is, the user can take an action to initiate communication between the RFID tag of the external device 213 and the RFID reader of the electronic device 100. If the electronic device 100 is in the radio range of the RFID tag of the external device 211, the electronic device 100 and the external device 211 are connected to each other through a preset communication interface (e.g., interface between RFID reader and RFID tag).

Once the external device 213 is connected, the electronic device 100 reads out the tag information from the RFID tag of the external device 213 and converts the tag information into the form of execution information that can be read by the electronic device 100. Next, the electronic device 100 performs parsing of the execution information to acquire the application identity information of the application 2 as shown in Table 1. As a result, the electronic device 100 loads the application 2 identified by the application identity information to execute the user-intended task. The application 2 is run to execute the user-intended task (i.e., message composition guide) in a stepwise manner. That is, the electronic device 100 outputs the video and/or audio data in series according to the progress of the message composition guide program.

A description is now made of the exemplary case where the user selects the external device 215.

If a decision is made to create phonebook data, the user selects the external device 215 having the tag information on the phonebook data creation. The tag information can be provided by an RFID tag. The user can connect the external device 215 to the electronic device 100. The connection between the external device 215 and the electronic device 100 can be done simply by placing the external device 215 close to the electronic device 100 such that the RFID reader of the electronic device 100 is within radio range of the RFID tag of the external device 215. That is, the user can take an action to initiate communication between the RFID tag of the external device 215 and the RFID reader of the electronic device 100. If the electronic device 100 is in the radio range of the RFID tag of the external device 211, the electronic device 100 and the external device 211 are connected to each other through a preset communication interface (e.g., interface between RFID reader and RFID tag).

Once the external device 215 is connected, the electronic device 100 reads out the tag information from the RFID tag of the external device 215 and converts the tag information into the form of execution information that can be read by the electronic device 100. Next, the electronic device 100 performs parsing on the execution information to acquire the application identity information of the application 3 as shown in table 1. At this time, the electronic device 100 also can acquire the data information as shown in table 1.

As a result, the electronic device 100 loads the phonebook application (application 3) identified by the application identity information to create the phonebook data. The application 3 is run to execute the user-intended task (i.e., phonebook data creation) in a stepwise manner. That is, the electronic device 100 executes the phonebook application and creates phonebook data by inputting content automatically. If there is no data information in the execution information, the electronic device 100 executes the phonebook application with a phonebook editing screen such that the user can input phonebook data manually.

Here, the data information can be composed of the field information and content information as shown in Table 1. The content information indicates the content required for creating the data, and the field information indicates the field in which the content information is filled. There can be a plurality of fields including name field, phone number 1 field (mobile phone), phone number 2 field (home), email field, address 1 (residential address), address 2 (web address), etc. When creating the phonebook data, the user can fill at least one of the fields with corresponding data.

When the application identity information is parsed along with the data information from the execution information, the electronic device 100 checks the fields for the content information by referencing the field information of the data information and creates the phonebook data by filling the fields with corresponding content information. For example, the electronic device 100 acquires field information elements <01: name>, <02: phone number 1>, and <03: email> and the content information mapped to the respective fields <01: name>, <02: phone number 1>, and <03: email>; and creates the phonebook data by filling the fields with corresponding content information automatically.

A description is now made of the exemplary case where the user selects the external device 217.

If a decision is made to compose a message, the user selects the external device 217 having the tag information regarding message composition. The tag information can be provided by an RFID tag. The user can connect the external device 217 to the electronic device 100. The connection between the external device 217 and the electronic device 100 can be done simply by placing the external device 217 close to the electronic device 100 such that the RFID reader of the electronic device 100 is within radio range of the RFID of the external device 217. That is, the user can take an action to initiate communication between the RFID tag of the external device 217 and the RFID reader of the electronic device 100. If the electronic device 100 is within radio range of the RFID tag of the external device 211, the electronic device 100 and the external device 211 are connected to each other through a preset communication interface (e.g., interface between RFID reader and RFID tag).

Once the external device 217 is connected, the electronic device 100 reads out the tag information from the RFID tag of the external device 217 and converts the tag information into the form of execution information that can be read by the electronic device 100. Next, the electronic device 100 performs parsing on the execution information to acquire the application identity information of the application 4 as shown in Table 1. At this time, the electronic device 100 also can acquire the data information as shown in table 1.

As a result, the electronic device 100 loads the messaging application (application 4) identified by the application identity information to compose a message. The application 4 is run to execute the user-intended task (i.e., message composition) in a stepwise manner. That is, the electronic device 100 executes the messaging application and composes a message by inputting a message content and called party information (phone number) automatically with reference to the data information. If there is no data information in the execution information, the electronic device 100 executes the messaging application with a messaging composition screen such that the user can compose a message by inputting the message content and the called party information manually.

Here, the data information can be composed of the field information and content information as shown in Table 1. The content information indicates the content required for composing the message and the called party information (phone number), and the field information indicates the fields in which the content information is filled. That is, the messaging application provides a field for inputting the message content and a field for inputting the called party information such that the user can fill the individual fields with corresponding information.

When the application identity information is parsed along with the data information from the execution information, the electronic device 100 checks the fields for the content information by referencing the field information of the data information and composes a message by filling the fields with corresponding content information. For example, the electronic device 100 acquires field information elements <01: name>, <02: phone number 1>, and <03: email> and the content information mapped to the respective fields <01: name>, <02: phone number 1>, and <03: email>; and composes a message by filling the fields with corresponding content information automatically.

Figure 5:
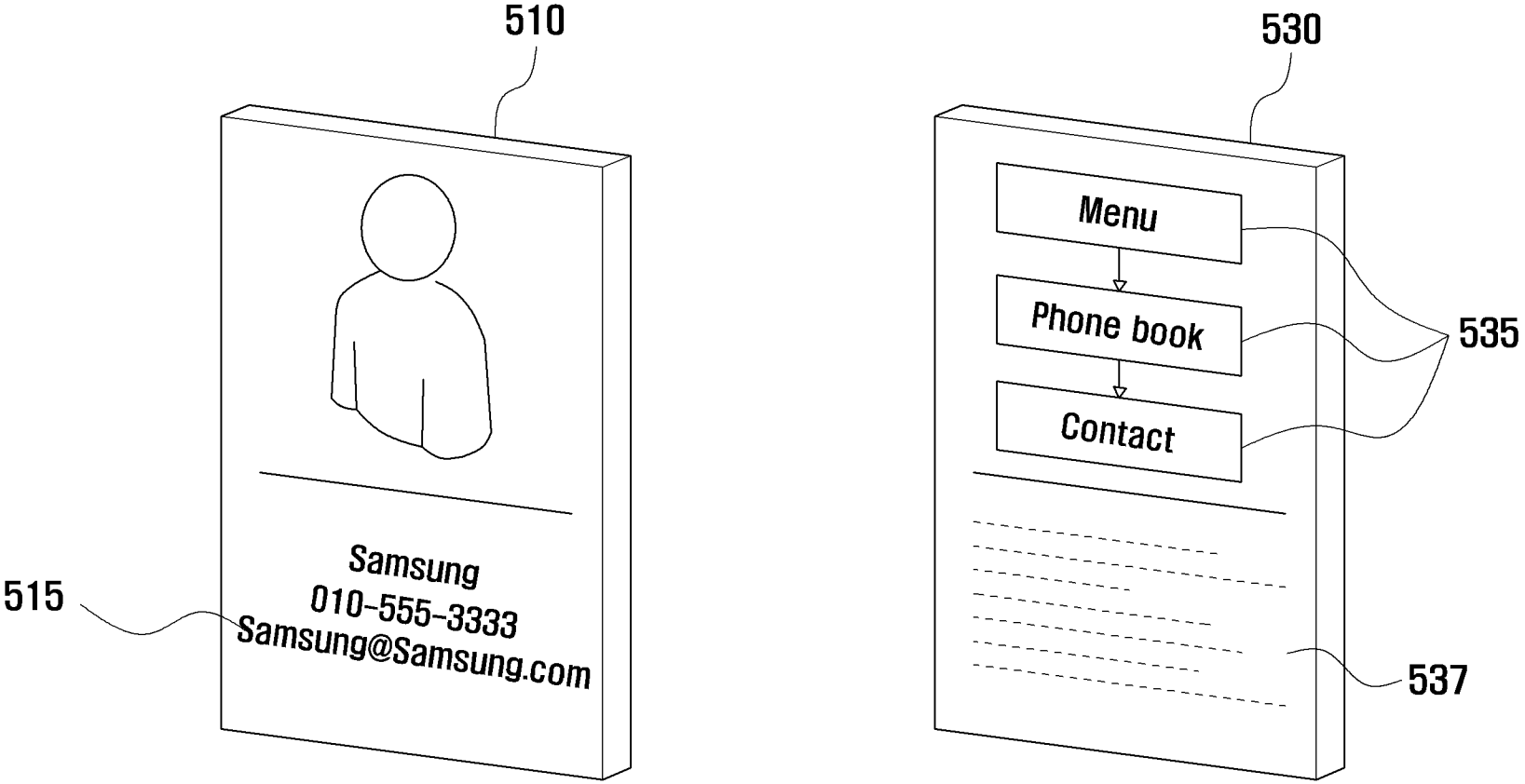
FIG. 5 is a diagram illustrating an exemplary external device according to an exemplary embodiment of the present invention.

FIG. 5 is a diagram illustrating an exemplary external device according to an exemplary embodiment of the present invention. Although the external device is depicted in the shape of a credit/business card in FIG. 5, the present invention is not limited thereto but can be implemented with the external devices formed in various shaped.

Referring to FIG. 5, reference number 510 denotes the front surface of the external device, and reference number 530 denotes the rear surface of the external device. The external device can have information labels 515 and 537 provided on its surfaces in order to provide information regarding its task or function. The information label 515 can provide the data information stored in the external device, and the information label 537 can provide the guide information explaining how to use the external device. The external device includes at least one RFID tag 535 for storing the tag information including the function information of the electronic device that can be controlled by means of the external device and the data information. The tag information of the external device can be stored in the RFID tag 535 so as to be read by the RFID reader of the electronic device. Although it is depicted that the external device is provided with an RFID tag in FIG. 5, the external device can be provided with a barcode or a control code.

Although depicted on the rear surface of the external device in FIG. 5, the RFID tag 535 may be installed inside of the external device or on a front surface or a side edge or a side of the front face of the external device depending on the design of the external device. The RFID tag 535 can store a plurality of tag information elements depending on the design of the external device.

As shown in FIG. 5, the external device can be designed in the shape of a business card or a credit card. The shape of the external device can be changed to secure portability and usability. The user can carry a plurality of external devices for different purposes and use one of the external devices to control the electronic device to provide user-intended information. In an exemplary case where the external devices are installed in the form of frames holding pictures exhibited in an art gallery along with the tag information (picture information), if the user connects an electronic device provided by the art gallery or carried in hand to one of the external devices (i.e., holds up the electronic device to the picture frame), the electronic device provides the information on the picture.

The external device can be implemented in the business card of the user. For example, the electronic device can be fabricated in the form of a business card on which the business information of the user (such as name, phone number, email address, and office) is printed and which has an RFID tag containing the personal information. In this case, the RFID tag-enabled business card can be used such that, when a person holds up the business card close to an electronic device, the electronic device reads out the business information from the business card and stores the read information. That is, the user can read out the phonebook data from the RFID tag-enabled business card and save the phonebook data read simply by using the electronic device.

Figure 6:
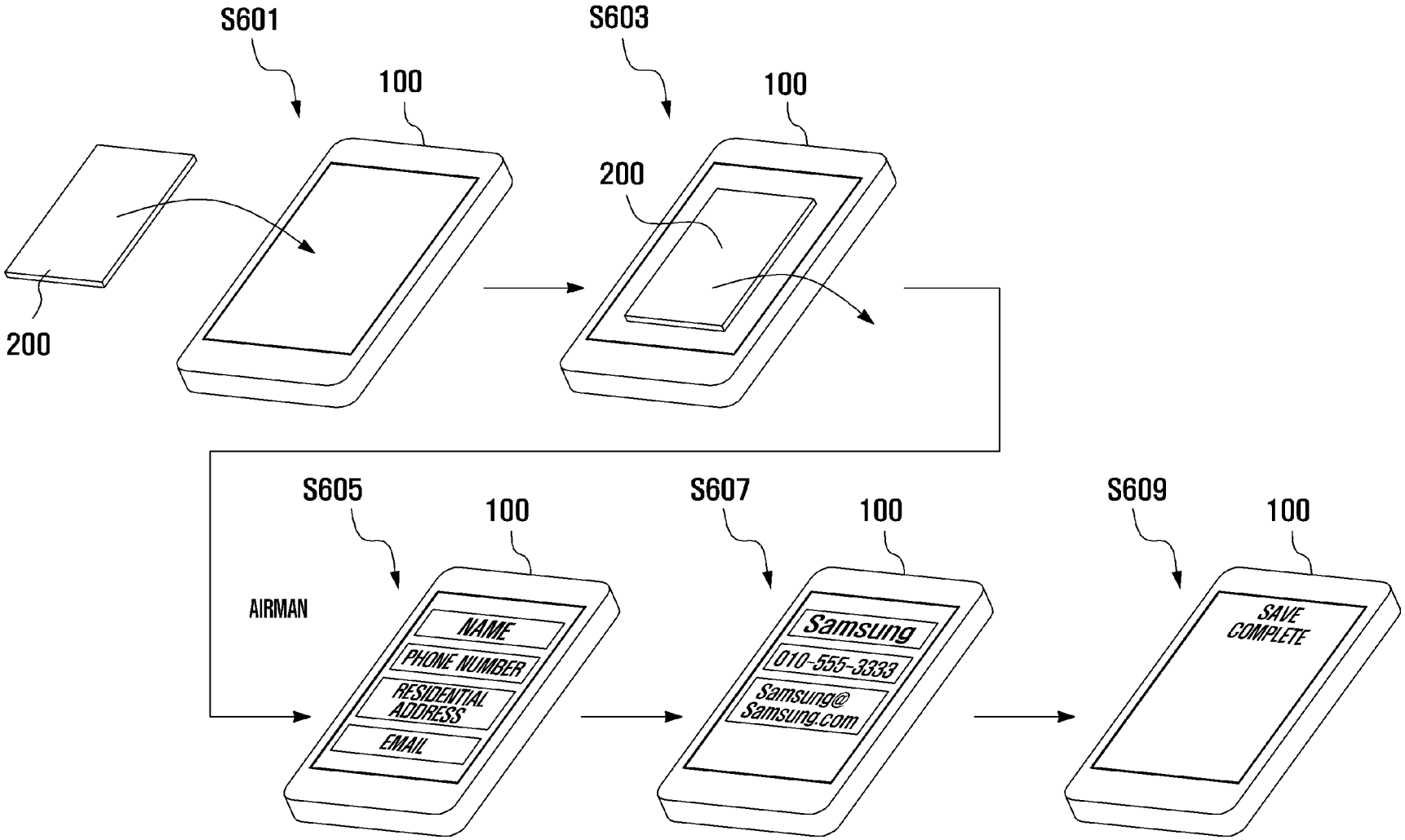
FIG. 6 is a diagram illustrating operations of the electronic device control system according to an exemplary embodiment of the present invention.

FIG. 6 is a diagram illustrating operations of the electronic device control system according to an exemplary embodiment of the present invention. In the embodiment of FIG. 6, the electronic device creates the phonebook data with reference to the information read out from an external device.

Referring to FIG. 6, if a decision is made to do a specific task, the user selects an external device 200 having the tag information associated with the task. Next, the user holds the external device 200 close to the electronic device 100 so as to establish a connection between the external device 200 and the electronic device 100 (S601 and S603). The connection between the external device 200 and the electronic device 100 can be established in the connection process between an RFID tag of the external device 200 and an RFID reader of the electronic device 100. However, it would be understood that other types of short-range communications modules may be utilized without altering the scope of the invention. For example, infrared or visible light communication protocols may be utilized without altering the scope of the invention claimed.

The electronic device 100 reads out the tag information from the RFID tag of the external device 200 by means of the RFID reader and converts the tag information into the form of execution information that can be read by the electronic device 100. Next, the electronic device 100 performs parsing of the execution information to extract application identity information and data information. Next, the electronic device 100 loads the application identified by the application identity information and displays the execution screen of the loaded application (S650).

FIG. 6 is depicted under the assumption that the execution information includes a phonebook application identity information and the associated data information having name, phone number, and email address. Accordingly, the electronic device 100 executes the phonebook application and displays the execution screen of the phonebook application at step S605.

After executing the phonebook application, the electronic device 100 fills the information fields of the phonebook data with reference to the data information (S607). In the exemplary case of FIG. 6, the information fields are filled with the information elements of the data information, i.e. the name field with the name "Samsung," the phone number field with the number "010-555-3333," and the electronic mail field with the (email) address "samsung@samsung.com."

Next, the electronic device 100 can wait for the detection of a user input according to the user configuration at step 607.

Afterward, the electronic device 100 saves the phonebook data created automatically and/or edited by the user in response to a save command and displays the saved complete screen (609). Also, the electronic device 100 can be configured such that the phonebook data structured according to the data information at step 607 are saved automatically and then the saved complete screen is display at step 609.

Figure 7:
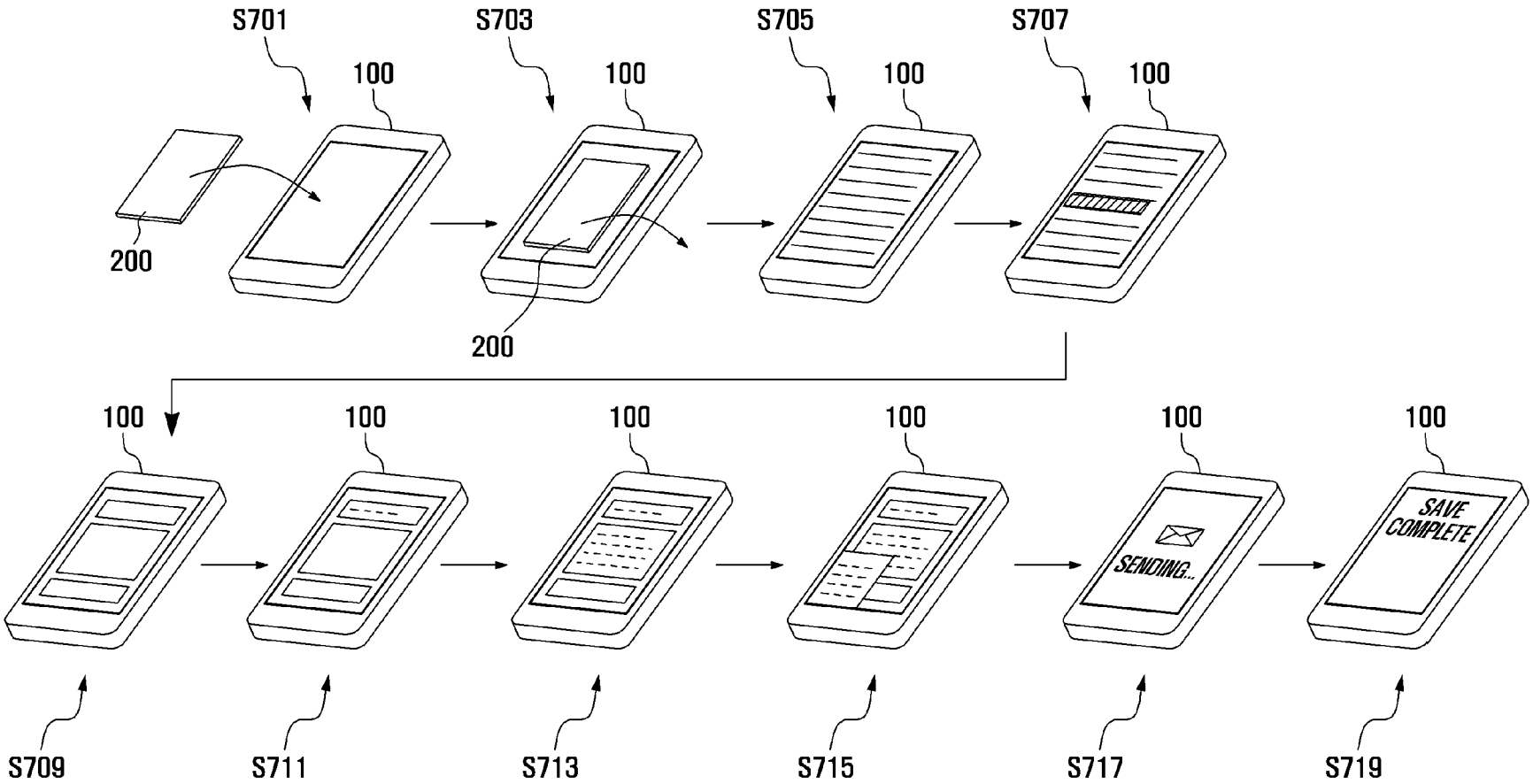
FIG. 7 is a diagram illustrating operations of the electronic device control system according to another exemplary embodiment of the present invention.

FIG. 7 is a diagram illustrating operations of the electronic device control system according to another exemplary embodiment of the present invention, in the embodiment shown in FIG. 7, the electronic device provides a message composition guide explaining how to compose a message with the external device as shown in FIG. 5.

Referring to FIG. 7, if a decision is made to do a specific task, the user selects an external device 200 having the tag information associated with the task. Next, the user holds up the external device 200 close to the electronic device 100 so as to establish a connection between the external device 200 and the electronic device 100 (S701 and S703). The connection between the external device 200 and the electronic device 100 can be established in the connection process between an RFID tag of the external device 200 and an RFID reader of the electronic device 100.

The electronic device 100 reads out the tag information from the RFID tag of the external device 200 by means of the RFID reader and converts the tag information into the form of execution information that can be read by the electronic device 100. Next, the electronic device 100 performs parsing of the execution information to extract application identity information and data information. Next, the electronic device 100 loads the application identified by the application identity information and displays the execution screen of the loaded application (S705).

FIG. 7 is depicted under the assumption that the execution information includes only the message composition guide application identity information without data information. Accordingly, the electronic device 100 executes the message composition guide application and displays the execution screen of the message composition guide application.

Here, the reference numbers S705 to S719 show the steps of providing the message composition guide program in series. As denoted by reference numbers S705 and S707, the electronic device 100 displays a series of screens for explaining the initial menu entry process and message composition application execution process in sequential order. Next, the electronic device 100 displays the guide screen for explaining about message composition in response to the selection of the message composition application at step 707 as denoted by reference number S709. Next, the electronic device displays the guide screens for explaining about how to input information in the individual information fields as denoted by reference numbers S711 and S713. Next, the electronic device 100 displays the guide screen for explaining how to transmit the composed message as denoted by reference numbers S715 and S717. The screens denoted by reference numbers S715 and S717 can be a series of screen for showing the message composition complete state, message transmission progress state, and message transmission complete state, respectively.

Next, the electronic device 100 provides a series of guide screens for explaining the message composition method as denoted by reference numbers S705 to S717 and then the screen showing entry into the standby mode after the completion of the guide application execution according to the configuration of the electronic device 100 as denoted by reference number S719. The electronic device 100 also can provide a screen asking for whether to replay the guide program at step as denoted by reference number S719.

In addition to the video data provided as described above, audio data can be provided in synchronization with the video data. The audio data can include speech and other effect sound for effective explanation.

Figure 8:
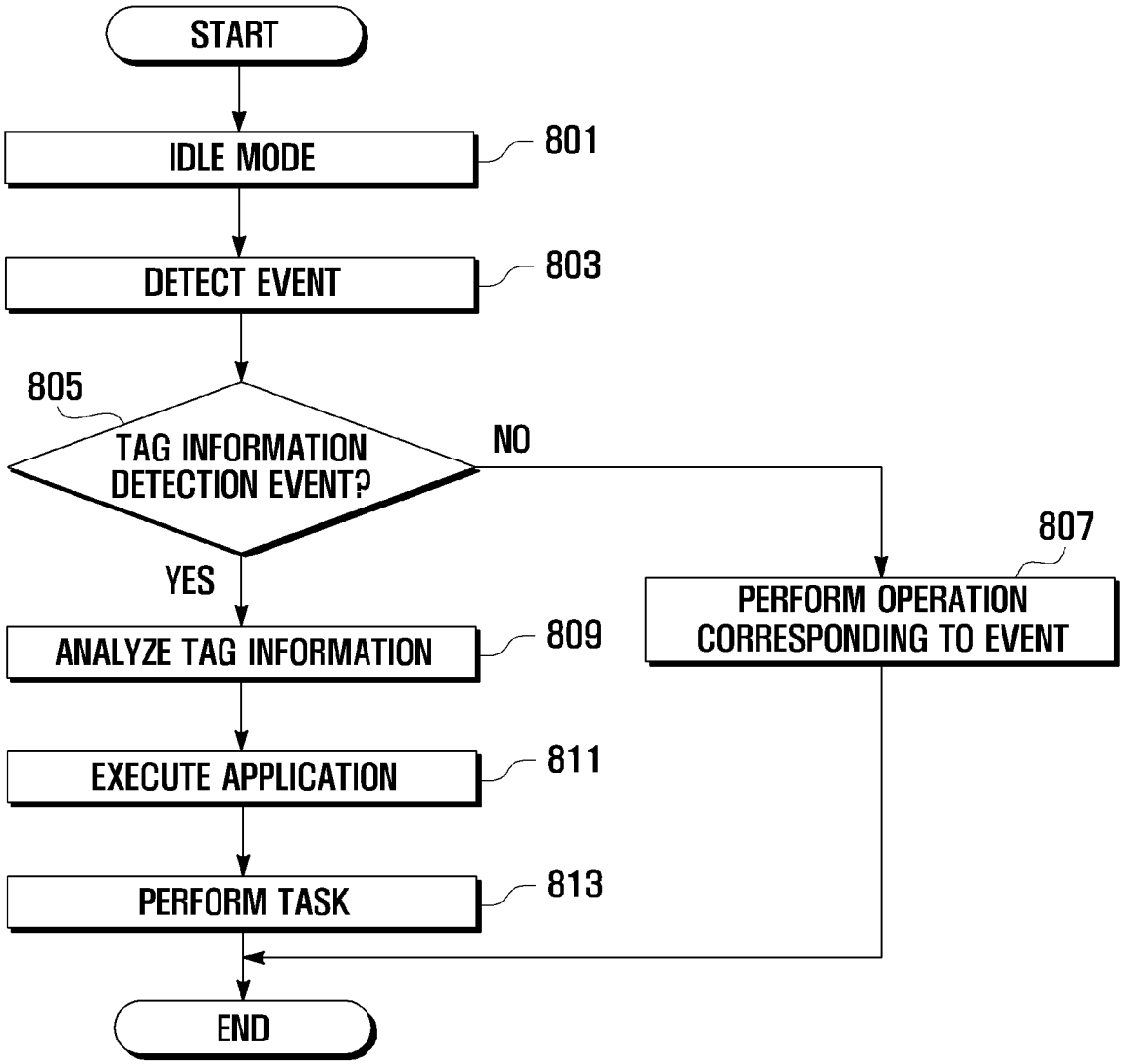
FIG. 8 is a flowchart illustrating an electronic device control method according to an exemplary embodiment of the present invention.

FIG. 8 is a flowchart illustrating an electronic device control method according to an exemplary embodiment of the present invention.

Referring to FIG. 8, the electronic device 100 operates in an idle mode (801). The electronic device 100 also can be in a specific operation mode while executing a specific function with display of execution screen.

While operating in idle mode, the electronic device 100 detects an event (803). If an event is detected, the electronic device 100 determines whether the event is a tag information detection event (805).

If the event is not the tag information detection event, the electronic device 100 performs an operation corresponding to the event (807). For example, if the event is an application execution trigger event for executing a specific application or a menu request event for requesting of a specific menu, the electronic device 100 executes the corresponding application or displays the requested menu.

If the event is the tag information detection event at step 805, the electronic device 100 analyzes the detection tag information (809). For example, the electronic device 100 may read out tag information from an RFID element of an external device by means of the electronic device's RFID reader, convert the tag information into a form of the execution information that can be read by the electronic device 100, and perform parsing of the execution information to extract the application identity information and/or data information. It would be recognized by those skilled in the art, the event may be initiated using other types of short-range communication protocols, such as infrared, optical, bar code, etc.

Next, the electronic device 100 loads and executes the application identified by the application identity information (811), as described with regard to the exemplary applications shown in Table 1. Next, the electronic device 100 performs the task intended with the execution of the application (813). For example, if the executed application is a guide application intended to teach an understanding of a specific function, the electronic device 100 executes the application to provide the function guide program. The function guide program can be provided with video and/audio data. The function guide program may be provided in the process as shown in FIG. 7. In case that the application is a specific function execution application, the electronic device 100 executes the function by means of the application. That is, the electronic device provides the execution screen of the application that has the information generated automatically on the basis of the data information. The function execution is performed in the process as shown in FIG. 6.

Figure 9:
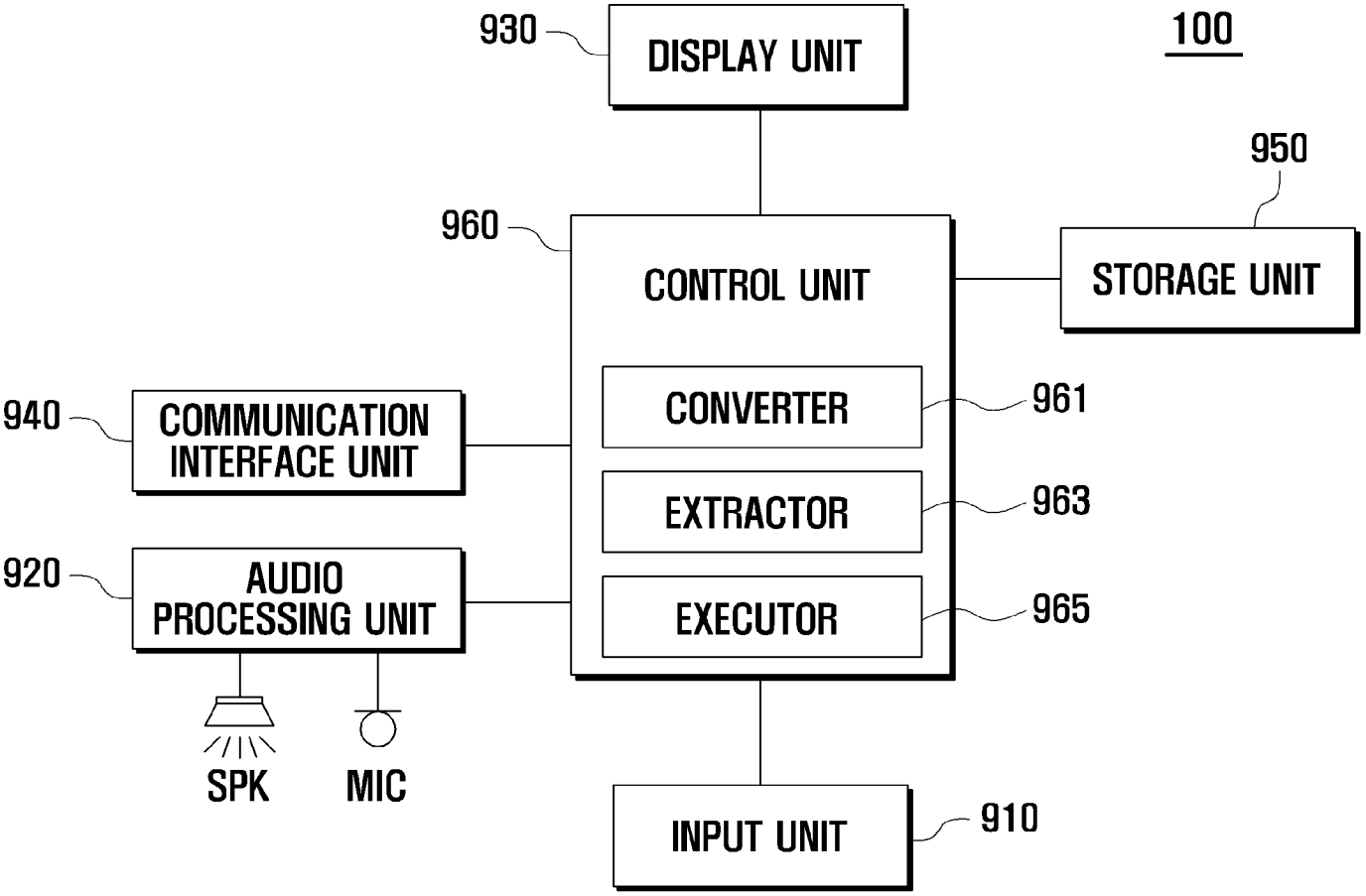
FIG. 9 is a block diagram illustrating an electronic device according to an exemplary embodiment of the present invention.

FIG. 9 is a block diagram illustrating an electronic device according to an exemplary embodiment of the present invention.

Referring to FIG. 9, the electronic device 100 includes an input unit 910, an audio processing unit 920, a display unit 930, a communication interface unit 940, a storage unit 950, and a control unit 960. The audio processing unit 920 includes a speaker (SPK) and a microphone (MIC), and the control unit 960 includes a converter 961, an extractor 963, and an executor 960. Descriptions are made of the individual function blocks hereinafter in detail.

The input unit 910 transfers the input signals generated in response to the alphanumeric data input operation, function configuration and/or control command input operation to the control unit 960. The input unit 910 is provided with a plurality of alphanumeric keys and functions keys. The function keys can include navigation keys, side keys, and shortcut keys. The input unit 910 can be implemented as at least one of a touchpad, a touchscreen, a normal keypad (e.g., 4×3 or 3×4 keypad), and a QWERTY keypad depending on the design of the electronic device 100. The input unit 910 can be disabled when the electronic device 100 is operating in association with an external device.

The audio processing unit 920 can include a speaker (SPK) for outputting audio data in the form of audible sound wave and a microphone (MIC) for collecting audio signal including user's voice. The audio processing unit 920 can be connected to the microphone (MIC) and the speaker (SPK). The audio processing unit 920 converts the audio signal input through the microphone (MIC) to digital data and outputs the digital data to the control unit 960. The audio processing unit 920 also outputs the audio signal provided by the control unit 960 through the speaker (SPK) in the form of an audible sound wave. That is, the audio processing unit 920 converts the analog audio signal input through the microphone (MIC) to digital audio signal and converts the digital audio signal input by the control unit 960 to an analog audio signal to be output through the speaker (SPK). The audio processing unit 920 also can play various audio resources (e.g., audio signal of a guide program) stored in the electronic device in response to user's playback request.

The display unit 930 displays execution screens for various functions of the electronic device 100. For example, the display unit 930 displays a booting progress screen, an idle mode screen, a menu screen, and a call progress screen. That is, the display unit 930 can display visual data related to the operation status and conditions of the electronic device 100. The display unit 150 can be implemented with one of a Liquid Crystal Display (LCD) panel, an Organic Light Emitting Diodes (OLED) panel, an Active Matrix OLED (AMOLED) panel and a LED panel. The display unit 930 can be equipped with a touchscreen functionality. In this case, the display unit 930 can work as both the input and output devices.

The communication interface unit 940 can receive the tag information from an external device through a wired or wireless communication link and transfer the received tag information to the control unit 960. In an exemplary embodiment of the present invention, the electronic device 100 can be implemented with multiple communication interface units for supporting different wired and/or wireless interfaces. The communication interface can be implemented with at least one of Bluetooth module, Ultra Wideband (UWB) module, ZigBee module, Radio Frequency Identification (RFID) reader, barcode reader, and connector interface depending on the design of the electronic device 100. In an exemplary embodiment of the present invention, the description is made under the assumption that the communication interface unit 940 is an RFID reader.

The communication interface unit 940 can be implemented in one of the following structures to acquire the tag information from an external device and transfer the acquired tag information to the control unit 960. In case that the communication interface unit 940 is implemented with an RFID reader, the RFID reader reads out the tag information from an RFID tag within its radio range and transfers the tag information to the control unit 960. Since other communication interface modules operate in similar manner to the RFID reader, detailed description about the operations of other communication interface modules are omitted herein. However, such modules are well-known and a fully description of their operation would be within the knowledge of those skilled in the art.

The storage unit 950 can be implemented with a Read Only Memory (ROM) and/or a Random Access Memory (RAM). The storage unit 950 stores various types of data generated and used in the electronic device 100. The data include application data (e.g., phonebook data and message data) and generated while running corresponding applications and various types of data received from other devices (e.g., base station, mobile phone, and personal computer) and applications for executing specific functions/menus supported by the electronic device 100. The storage unit 950 can store the data and settings related to the communication interface unit 940.

The storage unit 950 can include at least one buffer (not shown) for buffering the data generated while executing functions of the electronic device 100. For example, the storage unit 950 can buffer the signals transmitted and received through the communication interface unit 940 in units of predetermined size. The storage unit 950 also can buffer the data generated, in unit of predetermined size, while the electronic device 100 is running by means of an external device.

The storage unit 950 can include at least one memory module implanted inside of the mobile terminal and an external storage such as smartcard. The storage unit 950 can include at least one of a ROM, a Flash Memory, a RAM, and any combined form of these storage media, e.g., Multi Chip Package (MCP) memory.

The control unit 950 controls the operations of the wireless device 100 and signal flow among internal function blocks of the electronic device 100. The control unit 950 controls signaling among the input unit 910, the audio processing unit 920, the display unit 930, the communication interface unit 940, and the storage unit 950.

Particularly in an exemplary embodiment of the present invention, the control unit 960 converts the tag information read by the communication interface unit 940 and extracts the application identity information and/or data information from the execution information. The control unit 960 also controls a series of tasks performed in association with the functions executed in response to the execution information. For example, the control unit 960 executes a specific application corresponding to the execution information and controls the operation of the application such as function guide or data generation.

The control unit 960 can include a converter 961 for converting the tag information detected by means of the communication interface unit 940 into execution information that can be read by the electronic device 100, an extractor for parsing the execution information to extract application identity information and/or data information and extracting the field information and content information from the data information, and an executor 965 for loading and executing the application identified by the application identity information. The functions of the converter 961, extractor 963, and executer 965 of the control unit 960 can be implemented in software. In this case, the electronic device 100 can be implemented without change of hardware. The control unit 960 can control the operations as described with reference to FIGS. 1 to 8.

Although the electronic device 100 is depicted in schematic manner for simplifying the explanation, the present invention is not limited to such configuration of the electronic device.

The control unit 960 can include a baseband module and a Radio Frequency (RF) module (not shown) such that the electronic device 100 supports a mobile communication service. The baseband module can be integrated into the individual control unit 960 and RF unit, or integrated in one of the control unit 960 and RF unit.

Although not depicted in FIG. 9, the electronic device 100 can further include at least one of a camera for taking a picture of a subject, an local area network module for supporting local area network communication, an Internet access module for supporting Internet accessing, a digital broadcast module for receiving and playing digital broadcast data such as Digital Multimedia Broadcasting (DMB) and Digital Video Broadcasting (DVB) data, and a short range wireless communication module such Bluetooth module for short range wireless communication. Although not enumerated here, other devices equivalent to the aforementioned function modules can be further included in the mobile terminal. Also, it is obvious to those skilled in the art that each of the internal function blocks constituting the wireless device 100 can be omitted or replaced by other equivalent device.

Although the description has been made with reference to FIGS. 1 to 9 under the assumption that the electronic device is equipped with a touchscreen, the present invention is not limited to the electronic device implemented with the touchscreen. For, example, the present invention can be applied to an electronic device implemented with a combination of a normal LCD display and a keypad and/or touchpad. The electronic device 100 according to an exemplary embodiment of the present invention can be implemented so as to be controlled by means of the microphone (MIC) or a motion sensor. That is, the electronic device 100 can be configured to be controlled by speech recognition function and motion detection function.

Although the description is directed to the mobile terminal having a full touchscreen as the electronic device with reference to FIGS. 1 to 9, the present invention is not limited thereto. For example, the present invention can be applied to the mobile terminals designed in any of folder type, bar type, and slide type. The electronic device 100 can be an intermediate or large scale display device.

As described above, the electronic device control system and method of the present invention is advantageous to simplify the control of the electronic device using an external device. Also, the electronic device control system and method of the present invention is advantageous for the user to avoid unnecessary trial and error for learning the method of operating an electronic device. Also, the electronic device control system and method of the present invention is capable of facilitating the presenting and reading device usage manual in clear and intuitive manner with the application executed automatically in association with an external device, resulting in improvement of learning effect of the user.

As described above, the electronic device control system and method of the present invention is capable of providing the user (especially first using or feeling difficulty to use electronic devices) with intuitive and efficient electronic manual. Also, the electronic device control system and method of the present invention allows the user to execute an electronic manual of the device simply using an external device, thereby improving user's comfort and usability of the electronic device. Also, the electronic device control system and method of the present invention is capable of executing a specific application or the electronic device an inputting data related to the application automatically such that the user can perform a specific task such as message composition and phonebook data creation only by holds up an external device close to the electronic device. Also, the electronic device control system and method of the present invention is capable of inputting a series of commands using an external device without manipulation of input means such as keypad, touchscreen, and keyboard, resulting in improvement of utilization efficiency of the electronic device.

The above-described methods according to the present invention can be realized in the control unit in hardware or as software or computer code that can be stored in a recording medium such as a CD ROM, an RAM, a floppy disk, a hard disk, or a magneto-optical disk or downloaded over a network, so that the methods described herein can be rendered in such software using a general purpose computer, or a special processor or in programmable or dedicated hardware, such as an ASIC or FPGA. As would be understood in the art, the control unit (as represented by a computer, a processor or a programmable hardware) may include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

Although exemplary embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A method for controlling an electronic device, comprising:

acquiring, at the electronic device, a tag information of an external device comprising at least one application for execution by the electronic device while the electronic device is operating in an idle mode and the external device is within a wireless range of the electronic device;

converting the tag information into execution information;

extracting application identity information and data information from the execution information;

executing the at least one application associated with the application identity information; and executing a task intended with the execution of the at least one application, wherein executing the task comprises generating specific data as a consequence of the at least one application execution or outputting of guide information for helping the user learn about a specific function of the electronic device.

2. The method of claim 1, wherein acquiring a tag information comprises:

sensing a connection of the external device to the electronic device through a predetermined communication interface; and reading out tag information from the external device through the communication interface, the tag information including information regarding at least one task of the electronic device.

3. The method of claim 2, wherein extracting application identity information comprises:

parsing the converted execution information;

extracting the application identity information from the execution information; and extracting the data information from the execution information when the data information in the execution information is identified.

4. The method of claim 1, wherein the data information comprises field information and content information.

5. The method of claim 3, wherein executing the task comprises:

loading a specific application identified by the application identity information; and controlling the execution of the task by the loaded application.

6. The method of claim 5, wherein controlling the execution of the task comprises activating a guide mode for guiding the specific function of the electronic device; and executing a user-intended task in a stepwise manner according to the execution information; and outputting video and/or audio data through corresponding output units as a result of the task execution.

7. The method of claim 6, wherein controlling the execution of the task comprises executing the specific application identified by the application identity information and displaying an execution screen of the specific application.

8. The method of claim 7, wherein controlling the execution of the task further comprises generating application data based on the data information by the specific application.

9. The method of claim 8, wherein generating the application data comprises filling data input fields of the specific application with data elements of the data information automatically.

10. An electronic device control system comprising:

an electronic device having a communication interface;

an external device having tag information that includes at least one application for execution by the electronic device; and wherein the electronic device acquires the tag information from the external device through the communication interface while operating in an idle mode when the external device is situated within a wireless range of the electronic device, converts the tag information into execution information, extracts application identity information and data information from the execution information, executes the at least one application associated with the application identity information, executes the task intended with the execution of the application, controls generate specific data as a consequence of the application execution or output of guide information for helping the user learn about a specific function of the electronic device.

11. The electronic device control system of claim 10, wherein the communication interface comprises at least one of a wired communication interface and a wireless communication interface.

12. The electronic device control system of claim 11, wherein each of the electronic device and the external device comprises a communication interface unit for establishing the communication interface.

13. The electronic device control system of claim 12, wherein the communication interface is a Radio Frequency Identification (RFID) interface, the external device comprises an RFID tag, and the electronic device comprises an RFID reader.

14. The electronic device control system of claim 13, wherein the electronic device comprises a control unit extracts the application by identity information from the execution information, loads the application corresponding to the application identity information, controls execution of the task with the application, and extracts the data information from the execution information when the data information in the execution information is detected.

15. The electronic device control system of claim 14, wherein the control unit comprises:

a converter that converts the tag information into the execution information that can be read by the electronic device;

an extractor that performs parsing on the execution information to extract application identity information and data information; and an executor that loads the specific application indicated by the application identity information to execute the task.

16. The electronic device control system of claim 14, wherein the control unit executes at least one of: a guide application for understanding of the specific function of the electronic device and a specific application; and wherein the control unit fills data input fields of the specific application with data elements of the data information automatically.

17. An electronic device comprising:

a communication interface unit that reads out tag information from an external device situated within a wireless range of the electronic device through a wired or wireless communication interface that includes at least one application for execution;

a control unit that acquires the tag information of the external device while operating in an idle mode, converts the tag information into execution information, extracts application identity information and data information from the execution information, executes the at least one application associated with the application identity information, and controls execution of a task intended with the execution of the at least one application; and an output unit that outputs at least one of video data and audio data as a result of the task execution, wherein the control unit that controls generate specific data as a consequence of the application execution or output of guide information for helping the user learn about a specific function of the electronic device.

18. The electronic device of claim 17, wherein the control unit comprises:

a converter that converts the tag information into the execution information that can be read by the electronic device;

an extractor that performs parsing on the execution information to extract application identity information and data information; and an executor that loads a specific application indicated by the application identity information to execute the task.

19. An electronic device comprising:

a short-range communication protocol interface;

a processor in communication with a memory, the memory including code, which when accessed by the processor causes the processor to:

read tag information from an external device within a wireless range of the electronic device through the short range communication protocol interface while operating in an idle mode, the tag information including information regarding at least one task of the electronic device;

convert the tag information to execution information;

extract application identity information and data information from the execution information;

load a specific application corresponding to the application identity information;

execute a task intended with the execution of the specific application; and generate specific data as a consequence of the application execution or output of guide information for helping the user learn about specific function of the electronic device.

20. The electronic device of claim 19, further comprising: an output unit for outputting at least one of a video signal and an audio signal associated with the executed task.

* * * * *

UNITED STATES PATENT AND TRADEMARK OFFICE

CERTIFICATE OF CORRECTION

PATENT NO. : 8,988,194 B2
APPLICATION NO. : 12/883246
DATED : March 24, 2015
INVENTOR(S) : Dok Shin Lim It is certified that error appears in the above-identified patent and that said Letters Patent is hereby corrected as shown below:

In the Claims

Column 18, Claim 1, Lines 46-47 should read as follows:
--...helping a user learn...--

Column 19, Claim 10, Line 42 should read as follows:
--...helping a user learn...--

Column 20, Claim 17, Line 34 should read as follows:
--...helping a user learn...--

Column 20, Claim 19, Line 65-66 should read as follows:
--...helping a user learn...--

Signed and Sealed this
Seventh Day of July, 2015

Michelle K. Lee

Michelle K. Lee
*Director of the United States Patent and Trademark Office*